US006666575B2

(12) United States Patent
Scheufele

(10) Patent No.: US 6,666,575 B2
(45) Date of Patent: Dec. 23, 2003

(54) BALANCE WHEEL PROVIDED WITH AN ADJUSTMENT DEVICE

(75) Inventor: Karl-Friedrich Scheufele, Prangins (CH)

(73) Assignee: Chopard Manufacture SA, Fleurier (CH)

( * ) Notice: Subject to any disclaimer, the term of this patent is extended or adjusted under 35 U.S.C. 154(b) by 0 days.

(21) Appl. No.: 10/389,764

(22) Filed: Mar. 18, 2003

(65) Prior Publication Data

US 2003/0179655 A1 Sep. 25, 2003

(51) Int. Cl.[7] ..... G04B 15/00; G04B 19/20; G04F 5/00

(52) U.S. Cl. ..... 368/127; 368/161; 368/171

(58) Field of Search ..... 368/124, 127, 368/158, 160, 161, 169, 170, 171, 173

(56) References Cited

U.S. PATENT DOCUMENTS 3,695,032 A * 10/1972 Lawson ..... 368/171

RE28,794 E * 5/1976 Tilse ..... 368/171

FOREIGN PATENT DOCUMENTS

| | | |
|---|---|---|
| CH | 125520 | 4/1928 |
| CH | 196706 | 6/1938 |
| CH | 261431 | 8/1949 |
| CH | 280067 | 4/1952 |
| GB | 845773 | 8/1960 |

* cited by examiner

*Primary Examiner*—Vit Miska
(74) *Attorney, Agent, or Firm*—Young & Thompson

(57) ABSTRACT

The balance wheel, particularly for a timepiece movement, provided with an adjustment device of its inertia to adjust its frequency of oscillation, comprises a rim (1) of circular shape, free from projecting portions, connected by radial arms (2) to a hub (3). At the intersection of each arm (2) with the rim (1) the latter comprises a recess (4) opening on one of its surfaces, the bottom of this recess (4) comprising a passage (6) opening on the other surface of the rim (1). Balance weights (7) having a general U shape are introduced into these recesses (4) by resilient deformation, these balance weights (7) being held in the desired angular position within corresponding recesses (4) by friction due to the resilience of these balance weights (7) themselves.

8 Claims, 1 Drawing Sheet

BALANCE WHEEL PROVIDED WITH AN ADJUSTMENT DEVICE

The present invention has for its object a balance wheel for a timepiece movement provided with an adjustment device of its inertia, permitting adjusting its frequency of oscillation.

Most of the balance wheels of this type comprise adjustment screws radially screwed into the rim of the balance wheel from the outside of the latter. Swiss patent 196,706 discloses such a balance wheel. These balance wheels with radial adjustment screws have drawbacks which are principally the difficulty of guaranteeing an adjustment established in the course of operation of the movement, one or the other of the screws being likely to unscrew partially or totally; the difficulty of access to the screws to carry out adjustment of the inertia of the balance wheel, and the large friction of the perimeter of the balance wheel with air, the screws giving rise to turbulence and friction which impede the good operation and regularity of the balance wheel.

There is also known from British patent 845,773 balance wheels having in their lower surface adjustment screws whose mass is eccentric relative to their axis of rotation. If the adjustment of the balance wheel is facilitated by the accessibility of the screws from one of the surfaces instead of from its periphery, the screws extend beyond the rim of the balance wheel, giving rise to turbulence and braking, impeding the good operation of this balance wheel. Moreover, it is also difficult to ensure the desired positioning of the screws over the course of time such that misadjustment of the balance wheel is not excluded.

From Swiss 280,067, there is known a balance wheel whose rim is provided with resources opening on its upper surface, a pin being sunk in the rim in the middle of each recess. The balancing masses are engaged forcibly on these pins and permit following their angular orientation so as to modify the inertia of the balance wheel. Here again, the recesses opening laterally of the rim and the balancing masses opening outside this latter give rise to aerodynamic disturbances impeding the operation of the balance wheel.

Moreover, the machining of the recesses and the sinking of the pins into the rim are delicate and difficult operations.

Finally, there is known from Swiss 125,520, a balance wheel provided with adjustment screws screwed into the upper surface of the rim. Rondelles can be disposed between the rim and head of one or several screws to ensure adjustment. In this case, it is necessary to provide screw threading within the rim and the adjustment can take place only stepwise, by the addition of one or several rondelles, which is not sufficiently precise.

The present invention has for its object the provision of a balance wheel provided with a precise and continuous adjustment device, easy both to produce and to adjust and giving rise to only a minimum of aerodynamic disturbance during oscillating movement of the balance wheel.

The present invention has for its object a balance wheel particularly for movements of timepieces provided with an adjustment device for its inertia to adjust its frequency, which tends to achieve the objects set forth above and to avoid the drawbacks enumerated above, of the existing devices. The balance wheel according to the invention is distinguished by the characteristics set forth in claim 1.

The accompanying drawing shows schematically and by way of example an embodiment of the balance wheel for a timepiece movement provided with an adjustment device according to the invention.

Figure 1:
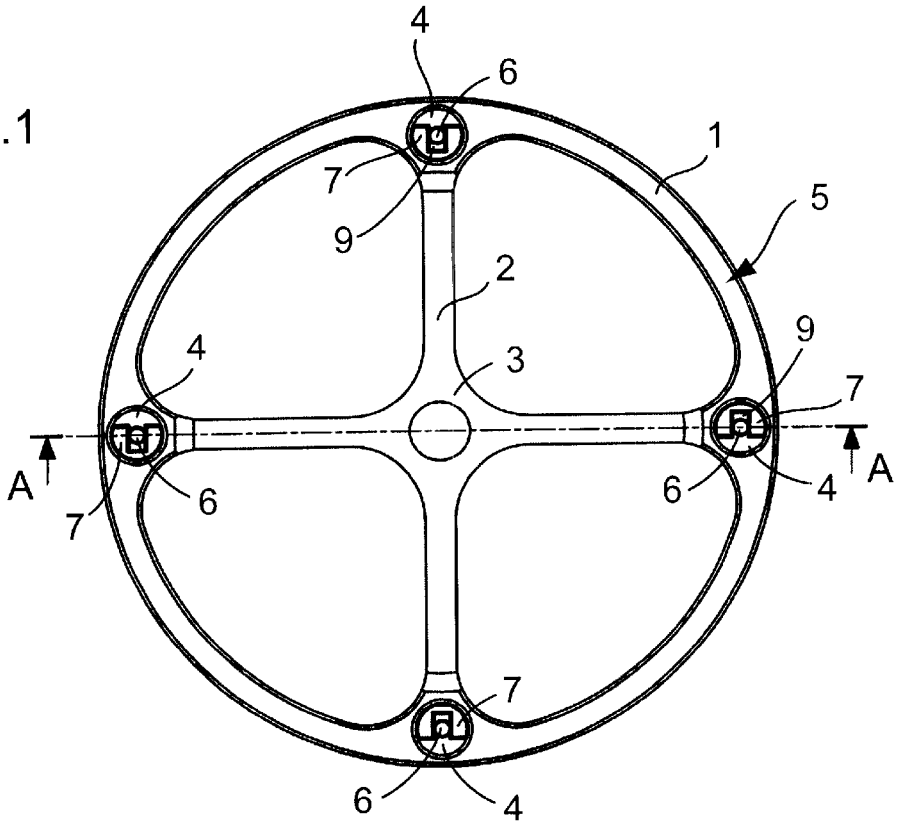
FIG. 1 is a plan view from above of the balance wheel according to the invention.
Figure 2:
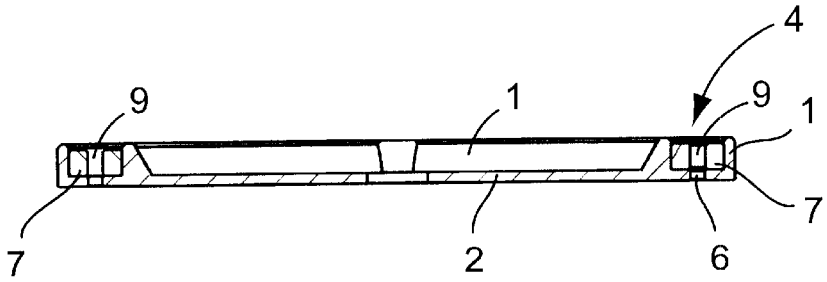
FIG. 2 is a cross-section on the line A—A of FIG. 1.
Figure 3:
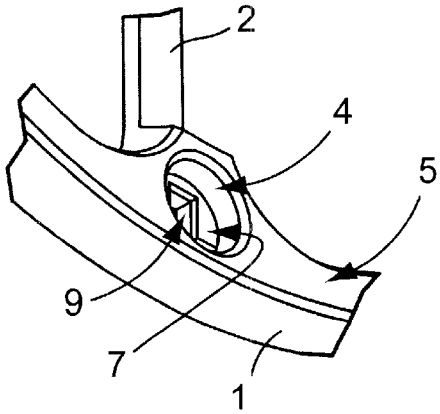
FIG. 3 is a fragmentary perspective view on a larger scale, of the balance wheel.

The balance wheel for a timepiece movement in particular, provided with an adjustment device for its inertia permitting adjustment of the frequency of oscillation of the balance wheel, comprises an annular rim 1, of circular or right cylindrical shape, connected by radial arms 2 to a hub 3. In the illustrated example, the balance wheel comprises four arms but it could comprise a different number, for example two or six.

The arms 2 are preferably thinner than the rim 1 as shown in the drawing. The connection between the arms 2 and the rim 1 is provided by continuous curves giving rise to the least possible aerodynamic disturbance during oscillation of the balance wheel. The rim 1 has a circular shape without any projecting portion, neither from above nor below nor from within nor from without, such that the disturbances due to friction with the air during movements of the balance wheel are reduced to the minimum possible.

The circular rim 1 has at its intersections with the radial arms 2 a greater width, which permits providing a circular recess 4 opening on one of the surfaces of the balance wheel, preferably its upper surface 5. The bottom of this recess 4 is provided with a hole or through passage 6 opening through another surface, the lower surface preferably, of the rim 1 of the balance wheel.

This balance wheel also comprises adjusting balance weights 7 having in plan view a general U shape, inscribed within a circle of a diameter corresponding to the diameter of the recesses 4 or slightly greater. Thus, these balance weights 7 can be forcibly introduced into the recesses 4 and are entirely sunk within these recesses, which avoids any friction with the air during oscillations of the balance wheel. During this introduction of the balance weights 7 into the recesses, these balance weights deform resiliently and are thus held by friction in their angular position in the recesses 4 under the force of the resilience of the balance weights 7 themselves.

With the help of a tool introduced into the slot of the balance weights 7, it is possible to cause them to pivot in the recesses 4 to adjust the inertia of the balance wheel. The width of the slot 8 of the balance wheels 7 is less than the diameter of the passage 6, such that it is possible with the help of a punch engaged in the holes 6 to disengage the counterweight 7 from its recess 4.

The balance wheel thus provided does not comprise any projection, neither on its external or internal periphery nor on its upper or lower surfaces, the balance weights 7 being entirely sunk in the recesses. Thus, the external shape of the balance wheel is simple and continuous, smooth and without irregularities and permits considerably reducing the force of friction or the flow of air about the balance wheel during its oscillations.

It is to be noted that the adjustment of the diurnal operation of the watch takes place by turning the balance weights on themselves within their recess 4 over a range of adjustment of 360°, which causes the moment of inertia of the balance wheel to vary. No matter what the adjustment, hence the position of the balance weights 7, the friction of air arising from the oscillations of the balance wheel remains constant and does not influence the operation of the latter.

Machining the balance wheel is simple and requires only piercing and reaming. The adjustment of the position of the balance weights 7 in the recesses 4 is easy, because they are accessible from the upper surface of the balance wheel and are not fixed in the recesses other than by the resilient force of securement due to the resilience of the balance weights 7 themselves.

The described balance weight thus permits achieving the objects set forth and overcoming the drawbacks of the earlier embodiments, particularly because of the fact that its upper and lower surfaces as well as its periphery are smooth and free from projections and that the adjusting balance weights are entirely sunk into the recesses provided in the rim.

What is claimed is:

1. Balance wheel, particularly for a timepiece movement, provided with an adjustment device for its inertia to adjust the frecuency of oscillation, characterized by the fact that it comprises a rim (1) of circular shape, free from projecting portions, connected by radial arms (2) to a hub (3); by the fact that at the intersection of each arm (2) with the rim (1) the latter comprises a recess (4) opening on one of its surfaces, the bottom of this recess (4) comprising a passage (6) opening on the other surface of the rim (1); by the fact that balance weights (7) having a general U shape are introduced into these recesses (4) by resilient deformation, these balance weights (7) being held in the desired angular position within corresponding recesses (4) by friction due to the resilience of these balance weights (7) themselves.

2. Balance wheel according to claim 1, characterized by the fact that it comprises an even number of arms (2).

3. Balance wheel according to claim 1, characterized by the fact that the adjusting balance weights (7) can be positioned in recesses (4) in a desired angular position over an adjustment range of 360°.

4. Balance wheel according to claim 1, characterized by the fact that the distance between the legs of the balance weights (7) of U shape is less than the dimension of the passages (6).

5. Balance wheel according to claim 2, characterized by the fact that the adjusting balance weights (7) can be positioned in recesses (4) in a desired angular position over an adjustment range of 360°.

6. Balance wheel according to claim 2, characterized by the fact that the distance between the legs of the balance weights (7) of U shape is less than the dimension of the passages (6).

7.Balance wheel according to claim 3, characterized by the fact that the distance between the legs of the balance weights (7) of U shape is less than the dimension of the passages (6).

8. Balance wheel according to claim 5, characterized by the fact that the distance between the legs of the balance weights (7.) of U shape is less than the dimension of the passages (6).

* * * * *

UNITED STATES PATENT AND TRADEMARK OFFICE

CERTIFICATE OF CORRECTION

PATENT NO. : 6,666,575 B2
DATED : December 23, 2003
INVENTOR(S) : Karl-Friedrich Scheufele It is certified that error appears in the above-identified patent and that said Letters Patent is hereby corrected as shown below:

Title page,
Insert item [30] as follows:
-- [30] Foreign Application Priority Data
March 21, 2002 [EU] Europe…….02006342.6 --.

Signed and Sealed this

Twenty-third Day of March, 2004

JON W. DUDAS
*Acting Director of the United States Patent and Trademark Office*